US005400914A

United States Patent [19]

Lin

[11] Patent Number: 5,400,914

[45] Date of Patent: Mar. 28, 1995

[54] SLIDING CONTAINER COVER

[76] Inventor: Chih-Ying Lin, No. 62 Lane 431 Hwa Chen Road Shin, Chuang City Tapiei Hsien, Taiwan, Prov. of China

[21] Appl. No.: 273,766

[22] Filed: Jul. 12, 1994

[51] Int. Cl.[6] ..... B65D 43/20

[52] U.S. Cl. ..... 220/345; 220/254; 220/339; 220/351; 229/125.12

[58] Field of Search ..... 220/254, 262, 331, 339, 220/345, 351, 242, 4.23; 229/125.12; 217/59

[56] References Cited

U.S. PATENT DOCUMENTS

| | | | |
|---|---|---|---|
| 2,199,787 | 5/1940 | Dillard | 220/254 X |
| 2,480,733 | 8/1949 | Hermani | 220/254 X |
| 2,582,360 | 1/1952 | Sheridan | 220/345 X |
| 2,757,859 | 8/1956 | Holland | 220/254 X |
| 3,527,373 | 9/1970 | Giraudet et al. | 220/345 |
| 3,720,346 | 3/1973 | Cypher | 220/254 X |
| 4,048,682 | 9/1977 | Smith | 220/345 X |
| 4,127,212 | 11/1978 | Waterbury | 220/254 |
| 4,196,844 | 4/1980 | Jacobson | 220/345 X |
| 5,083,672 | 1/1992 | Lewandowski | 215/322 |
| 5,145,088 | 9/1992 | Goujon | 220/355 |

*Primary Examiner*—Allan N. Shoap
*Assistant Examiner*—Vanessa Caretto
*Attorney, Agent, or Firm*—Jones, Tullar & Cooper

[57] ABSTRACT

A sliding container cover, which includes a rectangular base frame mounted on the top opening of a rectangular container, a rectangular cover frame hinged to the rectangular base frame at one side and openably covered over the rectangular base frame, and a sliding cover board made to slide in and out of the space defined between the rectangular base frame and the rectangular cover frame for controlling the top opening of the rectangular container.

5 Claims, 5 Drawing Sheets

SLIDING CONTAINER COVER

BACKGROUND OF THE INVENTION

The present invention relates to a sliding container cover which controls the access of the top opening of a rectangular container by sliding a sliding cover board.

Regular box containers for containing foods, liquid, etc., are generally made having a top opening and a top cover detachably covering on the top opening. When it is desired to pick up thing(s) from a box container, the top cover of the box container must be removed. After the desired thing(s) has (have) been taken out of the box container, the top cover must be replaced on the top opening of the box container again. However, frequently opening and closing the top cover of a box container will deform the top cover causing it to be difficult to close the box container.

SUMMARY OF THE INVENTION

The present invention has been accomplished to provide a sliding container cover which eliminates the aforesaid problem. According to one aspect of the present invention, the sliding container cover comprises a rectangular base frame mounted on the top opening of a rectangular container, a rectangular cover frame hinged to the rectangular base frame, and a sliding cover board made to slide in and out of the space defined between the rectangular cover frame and the rectangular base frame so as to control the access of the top opening of the rectangular container. According to another aspect of the present invention, a raised block is made on the sliding cover board at the top, which serves as a handle for moving the sliding cover board and, which stops the sliding cover board from falling out of the rectangular base frame when the sliding cover board is opened.

DETAILED DESCRIPTION OF THE PREFERRED EMBODIMENTS

Figure 1:
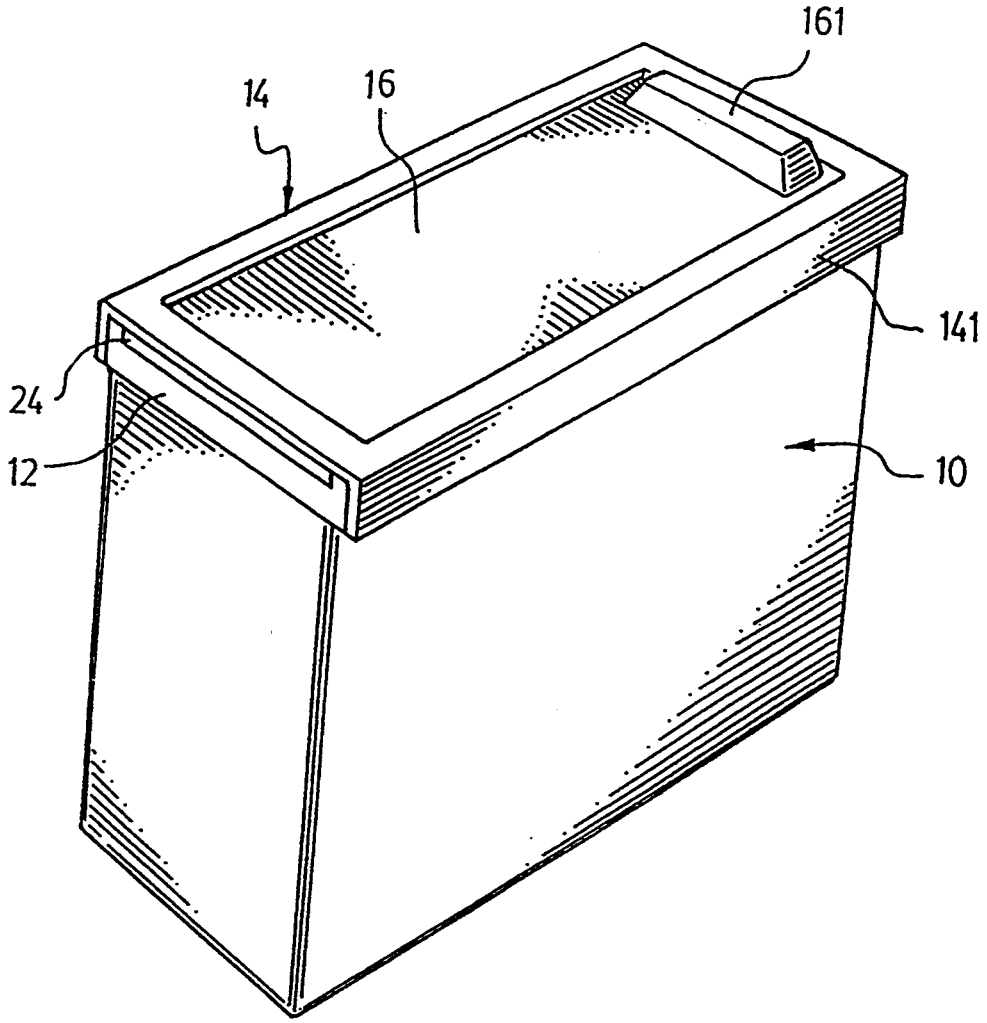
FIG. 1 is an elevational view showing a sliding container cover fastened to a rectangular container according to the present invention.
Figure 2:
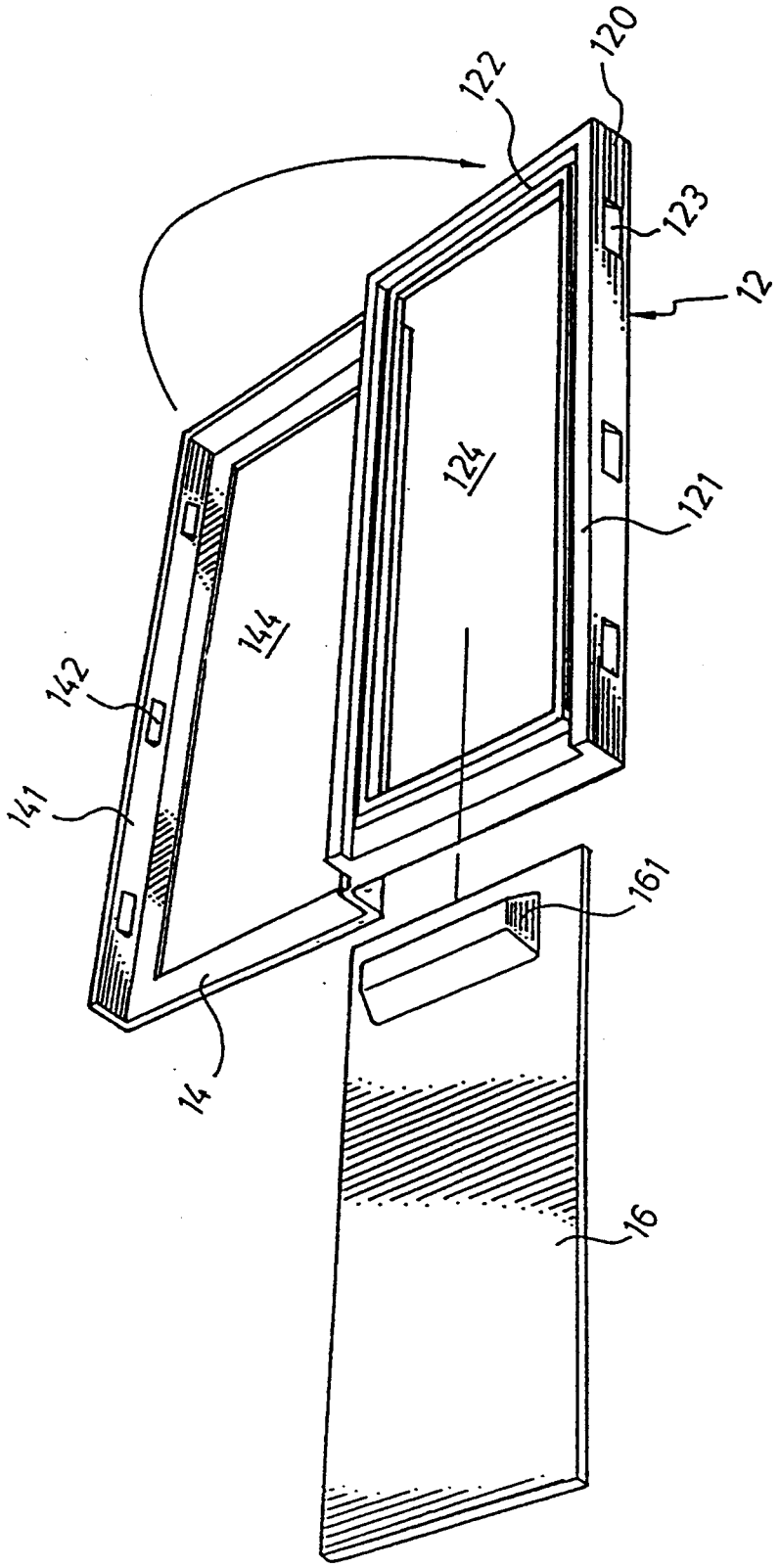
FIG. 2 is a dismantled view of the sliding container cover shown in FIG. 1.

Referring to FIGS. 1 and 2, a container cover in accordance with the present invention is provided for closing a container 10 at the top, generally comprised of a rectangular base frame 12, a cover frame 14, and a sliding cover board 16.

The base frame 12 comprises an inner flange 122 extending from the top around the rectangular center opening 124 thereof, and an outer flange 121 extending from the top along two opposite long sides and one short side thereof. The sliding cover board 16 is slidably supported on the inner flange 122 and disposed flush with the topmost edge of the outer flange 121. The cover frame 14 fits over the base frame 12, defining a rectangular center opening 144 corresponding to the center opening 124 of the base frame 12. The size of the center opening 124 is slightly smaller than that of the sliding cover board 16. The cover frame 14 comprises a vertical peripheral wall 141 around two opposite long sides and one short side thereof. One side of the vertical peripheral wall 141 is hinged to one long side of the base frame 12. The opposite side (opposite to the hinged side) of the vertical peripheral wall 141 is made with a plurality of hooks 142. The opposite long side 120 of the base frame 12 is made with a plurality of retaining holes 123. When the cover frame 14 is fitted over the base frame 12, the vertical peripheral wall 141 is closely attached to the outer flange 121 on the outside and the hooks 142 are respectively hooked in the retaining holes 123, and therefore the cover frame 14 and the base frame 12 are closed to hold the sliding cover board 16 in between. When the cover frame 14 and the base frame 12 are closed, an elongated narrow hole 24 is transversely defined between the cover frame 14 and the base frame 12 at one side for passing the sliding cover board 16. Therefore, the sliding cover board 16 can be drawn in and out of the base frame 12 through the hole 24. The cover board 16 further comprises a raised block 161 transversely disposed at the top. Through the raised block 161, the sliding cover board 16 can be moved with the hand. When the sliding cover board 16 is extended out of the hole 24, the raised block 161 is stopped inside the center opening 144 of the cover frame 14, and therefore the sliding cover board 16 does not disconnect from the base and cover frames 12 and 14.

Figure 3:
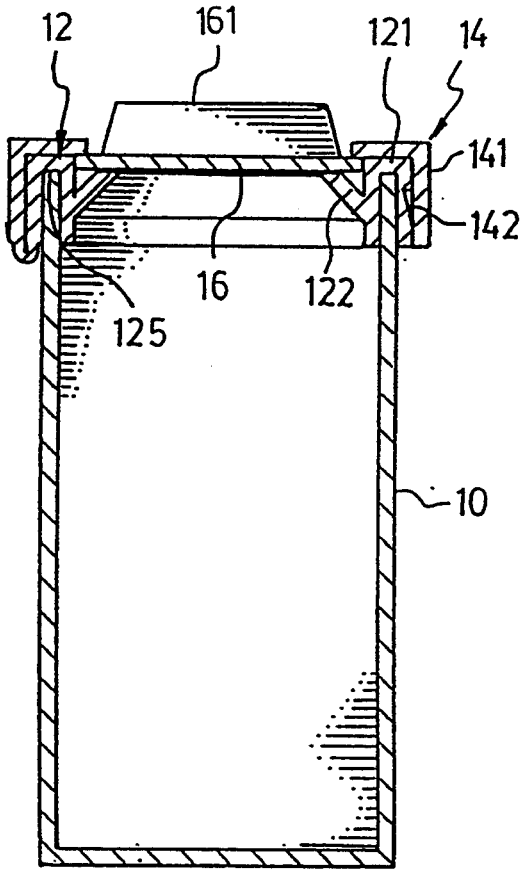
FIG. 3 is an end view in section of FIG. 1.
Figure 4:
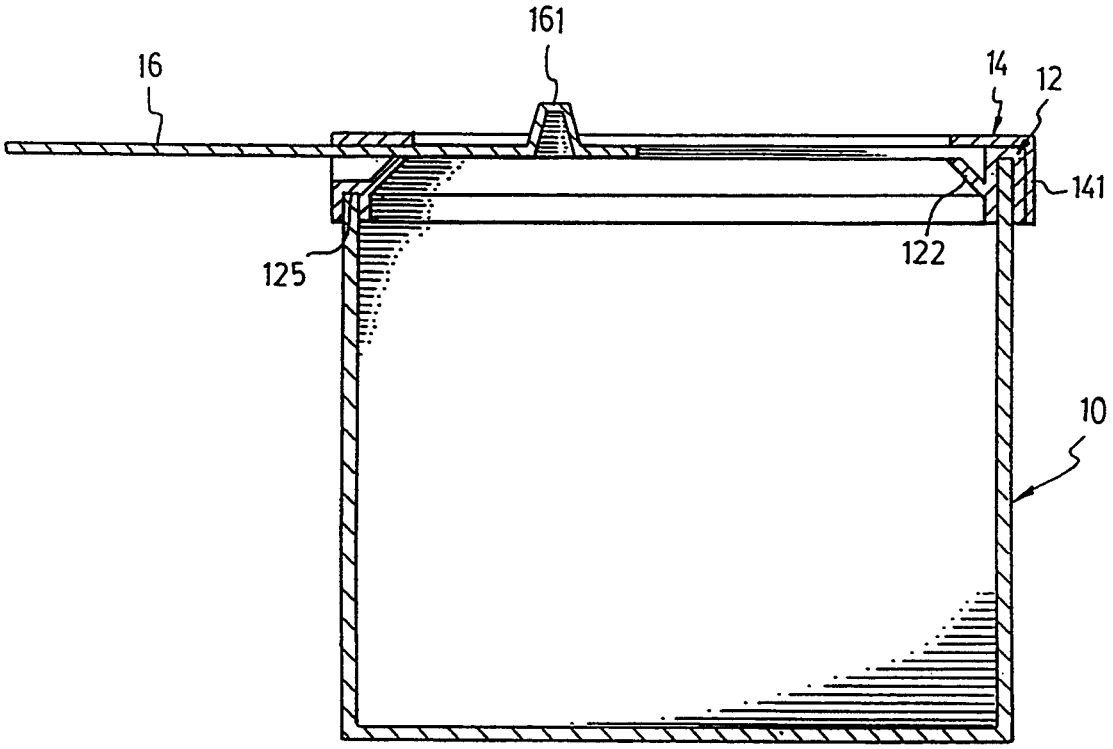
FIG. 4 is a side view in section of FIG. 1, but showing the sliding cover board opened.

Referring to FIGS. 3 and 4, the base frame 12 has an endless mounting groove 125 around the border at the bottom for mounting on the container 10. By fitting the topmost edge of the container 10 into the endless mounting groove 125, the base frame 12 is fastened to the container 10. After the sliding cover board 16 has been put on the base frame 12 within the outer flange 121, the cover frame 14 is covered on the base frame 12 by hooking the hooks 142 in the retaining holes 123. By moving the sliding cover board 16 in and out, the top opening of the container 10 is closed or opened.

Figure 5:
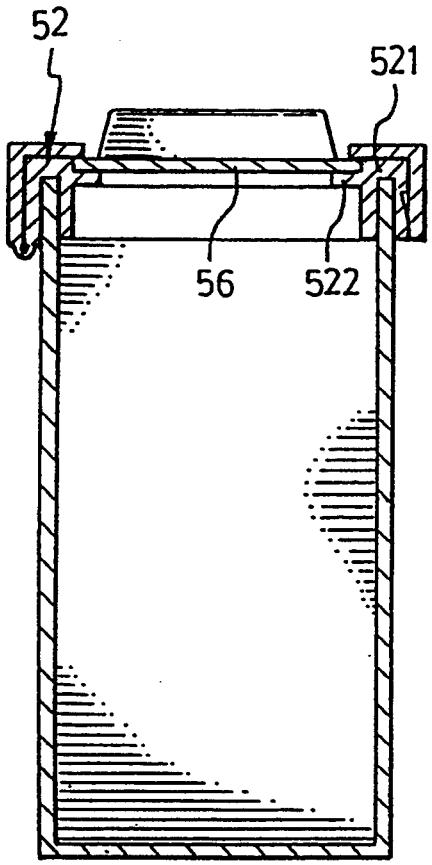
FIG. 5 is an end view in section of an alternate form of the present invention.

FIG. 5 illustrates an alternate form of the present invention, in which the base frame 52 has an inward flange 522 horizontally projected from the inside wall thereof at an elevation below the topmost edge 521 for supporting the sliding cover board 56, permitting the sliding cover board 56 to be moved in and out of the base frame 52.

While only two embodiments of the present invention have been shown and described, it will be understood that various modifications and changes could be made without departing from the spirit and scope of the invention.

What is claimed is:

1. A sliding container cover comprising:

a rectangular base frame mounted on a top opening of a rectangular container, having a center opening vertically aligned with the top opening of the rectangular container, and a vertical peripheral wall around three sides thereof defining a sliding way;

a sliding cover board supported on said rectangular base frame within the vertical wall thereof and horizontally moved in and out of said sliding way to control the top opening of the rectangular container; and a rectangular cover frame hinged to said rectangular base frame at one side for covering over said sliding cover board permitting said sliding cover board to be moved in and out of said sliding way.

2. The sliding container cover of claim 1 further comprising a fastening means for securing said rectangular cover frame in the position covering said rectangular base frame.

3. The sliding container cover of claim 2 wherein said fastening means comprises at least one retaining hole made on said rectangular base frame, and at least one hook made on said rectangular cover frame for fastening to said at least one retaining hole respectively.

4. The sliding container cover of claim 1 wherein said sliding cover board has a top surface and a handle on the top surface for moving by hand.

5. The sliding container cover of claim 4 wherein said handle is made on said sliding cover board on the top surface at one end such that it stops at one side wall of said rectangular cover frame when said sliding cover board is moved out of said sliding way.

* * * * *